US008168843B2

(12) United States Patent
Rock et al.

(10) Patent No.: US 8,168,843 B2
(45) Date of Patent: May 1, 2012

(54) REFORMATE BENZENE REDUCTION VIA TRANSALKYLATION

(75) Inventors: Kerry L. Rock, Houston, TX (US); Christopher C. Boyer, Houston, TX (US); Lawrence A. Smith, Jr., Pasadena, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 818 days.

(21) Appl. No.: 12/195,113

(22) Filed: Aug. 20, 2008

(65) Prior Publication Data

US 2010/0044273 A1 Feb. 25, 2010

(51) Int. Cl.
*C07C 6/12* (2006.01)

(52) U.S. Cl. ..... 585/470; 585/475

(58) Field of Classification Search ..... 585/470, 585/475

See application file for complete search history.

(56) References Cited

U.S. PATENT DOCUMENTS

| | | | | |
|---|---|---|---|---|
| 4,371,714 | A | | 2/1983 | Young |
| 4,469,908 | A | | 9/1984 | Burress |
| 4,849,569 | A | | 7/1989 | Smith, Jr. |
| 4,882,040 | A | | 11/1989 | Dessau et al. |
| 5,053,573 | A | | 10/1991 | Jorgensen et al. |
| 5,055,627 | A | | 10/1991 | Smith, Jr. et al. |
| 5,080,871 | A | | 1/1992 | Adams et al. |
| 5,087,783 | A | | 2/1992 | Johnson et al. |
| 5,118,872 | A | | 6/1992 | Smith, Jr. et al. |
| 5,196,574 | A | | 3/1993 | Kocal |
| 5,252,197 | A | * | 10/1993 | Alexander et al. ..... 208/134 |
| 5,273,644 | A | | 12/1993 | Wegerer |
| 5,347,061 | A | * | 9/1994 | Harandi et al. ..... 585/323 |
| 5,406,016 | A | | 4/1995 | Cook et al. |
| 5,446,223 | A | | 8/1995 | Smith, Jr. |
| 5,476,978 | A | | 12/1995 | Smith, Jr. et al. |
| 6,315,964 | B1 | | 11/2001 | Knifton et al. |
| 6,984,764 | B1 | | 1/2006 | Roth et al. |
| 7,253,331 | B2 | | 8/2007 | Martens et al. |
| 2004/0143146 | A9 | | 7/2004 | Schlosberg |
| 2007/0179329 | A1 | | 8/2007 | Clark |

OTHER PUBLICATIONS

International Search Report and Written Opinion dated Dec. 29, 2009 in International application No. PCT/US2009/044418.

* cited by examiner

*Primary Examiner* — Thuan Dinh Dang
(74) *Attorney, Agent, or Firm* — Osha · Liang LLP

(57) ABSTRACT

A process for reducing benzene content in a reformate stream, including: fractionating a full range reformate comprising benzene, $C_7$ to $C_9$ monoalkyl aromatics, and $C_{10+}$ polyalkyl aromatics into at least three fractions including a light reformate fraction comprising the benzene; a medium reformate fraction comprising the $C_7$ to $C_9$ monoalkyl aromatics; and a heavy reformate fraction comprising the $C_{10+}$ polyalkyl aromatics; feeding the light reformate fraction, the heavy reformate fraction and a transalkylation catalyst to a transalkylation reaction zone; contacting the light fraction and the heavy fraction in presence of the transalkylation catalyst in the transalkylation reaction zone to react at least a portion of the benzene with $C_{10+}$ polyalkyl aromatics to form monoalkyl aromatics; separating an effluent from the transalkylation reaction zone to form a catalyst fraction and a liquid fraction comprising the monoalkyl aromatics.

12 Claims, 1 Drawing Sheet

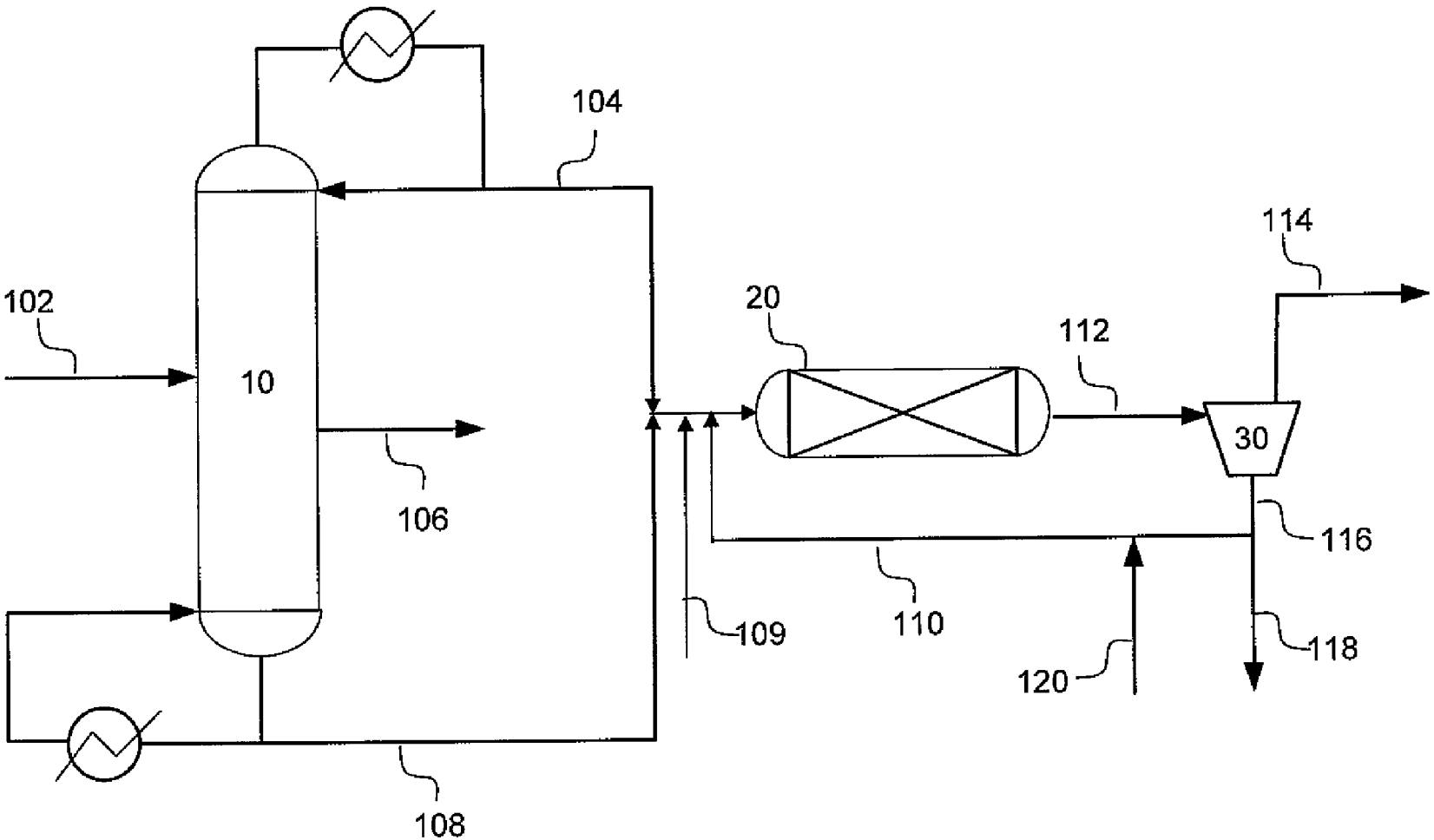
114
30
116
118
112
120
110
20
109
104
106
108
10
102

REFORMATE BENZENE REDUCTION VIA TRANSALKYLATION

BACKGROUND OF DISCLOSE

1. Field of the Disclosure

Embodiments disclosed herein relate generally to removal of benzene from a reformate stream via catalytic transalkylation with polyalkylate in presence of a heterogeneous slurry catalyst, which can be continuously replaced during the operation.

2. Background

The demand for cleaner and safer transportation fuels is becoming greater every year. Two major sources of gasoline feedstock, including reformate and cracked petroleum feedstocks, present both a problem meeting strict environmental regulations and impose certain health risks. For example, light reformate typically contains unacceptably high levels of benzene, a known carcinogen. Heavy reformate may contains unacceptably high levels of $C_{10}$ and heavier polyalkylate aromatics (polyalkylate) that diminish the value and the environmental quality of the fuel.

Refiners in the U.S. and in other countries are required to remove a substantial portion of the benzene from the reformate stream. Practical options to date include extraction, hydrogenation, alkylation, and transalkylation of benzene. Each of these options presents challenges, especially to a small or non-integrated refiner, from both a standpoint of cost and feasibility.

Extraction of benzene requires expensive capital investment in necessary equipment and a customer for the benzene product, neither of which may be feasible for a small non-integrated refiner. Also, while it is possible to extract benzene from the gasoline pool by fractionation techniques, such techniques are not preferred, because the boiling point of benzene is too close to that of some of the more desirable organic components, including $C_6$ paraffins and isoparaffins. Monoalkylate aromatics (monoalkylate), such as toluene and xylenes, are more desirable for gasoline blending, as opposed to benzene, because they are less objectionable both from an environmental and a safety point of view.

Alternatively, benzene in reformate may be removed via hydrogenation. However, hydrogenation of aromatics, such as benzene, toluene, and xylenes, results in reduced octane rating of the reformate stream, and thus diminishes the overall value of the fuel. As with extraction, hydrogenation of benzene also may not feasible for a small refiner due to potentially uneconomical costs associated with supplying hydrogen.

Alkylation of benzene with an olefin to form a monoalkylate product is another option available to refiners. Alkylation is not as effective in upgrading the overall fuel value of reformate, because it does not affect the polyalkylate content. Additionally, alkylation requires a readily available olefin source, and therefore may not be feasible for small refiners.

Therefore, there is still a significant need in the art for methods to reduce the levels of benzene and $C_{10}$ and heavier polyalkylate in refinery streams, including reformate, especially for smaller refining operations.

As taught in U.S. Pat. No. 5,053,573 and U.S. Pat. No. 5,406,016, the levels of both benzene and polyalkylate contained in refinery streams may be reduced and desirable monoalkylate product for gasoline blending may be produced via transalkylation in a fixed-bed reactor. For example, the benzene in light reformate may be transalkylated with the polyalkylate contained in heavy reformate.

Transalkylation refers generally to a type of chemical reaction that results in catalytic transfer of an alkyl group from a polyalkylate molecule, such as an aromatic hydrocarbon containing at least two alkyl groups, to a benzene molecule, to form monoalkylate product, an aromatic hydrocarbon containing only one alkyl group. Transalkylation may be used not only to reduce the content of benzene in gasoline feedstocks, but also to increase its octane rating while decreasing the content of polyalkylate, thus increasing the overall value of the fuel. A typical benzene transalkylation reaction is shown below.

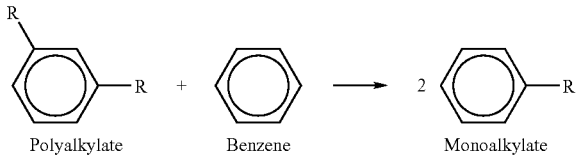

As disclosed in U.S. Pat. No. 5,446,223, transalkylation reactions may utilize non-polluting, non-corrosive, regenerable materials, such as zeolitic molecular sieve catalysts. U.S. Pat. Nos. 4,371,714 and 4,469,908 disclose straight pass alkylation and transalkylation of aromatic compounds using zeolitic molecular sieve catalysts in fixed beds.

One problem with using a zeolitic catalyst in alkylation reaction is rapid deactivation of the zeolitic catalyst due to coking and poisoning, resulting in frequent unit shut downs or other process interruptions, such as for thermal regeneration of the catalyst.

The catalyst deactivation rate due to coking or poisoning may be reduced by maintaining the zeolitic catalyst in at least a partial liquid phase, such as a hydrocarbon slurry. U.S. Pat. Nos. 5,080,871 and 5,118,872 disclose a moving bed reactor for alkylation and transalkylation of aromatic compounds, in which a slurry is produced by adding solid catalyst to the aromatic feed stream and is circulated through the reactor.

One advantage of a moving bed catalyst slurry reactor, as taught by U.S. Pat. Nos. 5,080,871 and 5,118,872, is that the catalyst may be continuously replaced and regenerated during operation, thus reducing the need for unit shut downs. The ability to remove deactivated catalyst on-line may eliminate the need to remove catalyst poisons from the feeds or regenerate the catalyst as for a fixed bed reactor, thus reducing the cost of the benzene removal unit.

To date, benzene removal from reformate by transalkylation has not been found economical, generally because of the costly equipment required to remove poisons from the liquid and gas streams and the duplication of reactors for catalyst regeneration. Therefore, there is still a significant need in the art for economical methods to reduce the levels of benzene and $C_{10}$ and heavier polyalkylate in refinery streams for smaller refining operations.

SUMMARY OF THE DISCLOSURE

In one aspect, embodiments disclosed herein relate to a process for reducing benzene content in a reformate stream, including: fractionating a full range reformate comprising benzene, $C_7$ to $C_9$ monoalkyl aromatics, and $C_{10+}$ polyalkyl aromatics into at least three fractions including a light reformate fraction comprising the benzene; a medium reformate fraction comprising the $C_7$ to $C_9$ monoalkyl aromatics; and a heavy reformate fraction comprising the $C_{10+}$ polyalkyl aromatics; feeding the light reformate fraction, the heavy reformate fraction and a transalkylation catalyst to a transalkylation reaction zone; contacting the light fraction and the heavy fraction in presence of the transalkylation catalyst in the transalkylation reaction zone to react at least a portion of the benzene with $C_{10+}$ polyalkyl aromatics to form monoalkyl aromatics; separating an effluent from the transalkylation reaction zone to form a catalyst fraction and a liquid fraction comprising the monoalkyl aromatics.

Other aspects and advantages will be apparent from the following description and the appended claims.

BRIEF DESCRIPTION OF DRAWINGS

FIG. 1 is a simplified flow diagram of a transalkylation process according to embodiments disclosed herein.

DETAILED DESCRIPTION

In one aspect, embodiments disclosed herein relate to processes for the reduction of benzene and polyalkyl aromatics content in reformate streams. In another aspect, embodiments disclosed herein relate to the transalkylation of benzene, where polyalkylated benzene is reacted with benzene to form a monoalkylate product. In another aspect, embodiments disclosed herein relate to reducing the benzene content in reformate by transalkylating benzene with polyalkyl aromatics contained in heavy reformate in the presence of a slurry catalyst.

Processes disclosed herein may be used to reduce benzene and polyalkyl aromatics concentrations in any number of hydrocarbon streams commonly found in a refinery. In some embodiments, hydrocarbon feeds to the processes disclosed herein may include reformate, and other heavy refinery streams containing polyalkyl benzenes. Catalytic reforming is a process in which hydrocarbon molecules are rearranged, or reformed in the presence of a catalyst. The molecular rearrangement results in an increase in the octane rating of the feedstock. For example, $C_6$ and $C_7$ paraffin components in a feed are converted into aromatics and recovered as a reformate product, wherein the conversion may be highly selective towards aromatics production. Naphtha reforming may also be utilized for production of benzene and monoalkyl aromatics. One example of a catalytic reforming process is disclosed in U.S. Pat. No. 4,882,040, among others.

In another aspect, embodiments disclosed herein relate to reducing the benzene content in reformate without loss of $C_7$ to $C_9$ components desirable for use in the gasoline pool. Monoalkyl aromatics in the reformate, such as toluene, ethylbenzene, cumene, and the like, are highly desirable for gasoline feedstock. To the contrary, it is desirable to reduce the benzene and polyalkyl aromatics concentration in reformate streams in order to meet environmental and safety regulations.

Reformate streams may include, for example, up to about 25 weight percent benzene or more, depending upon the feedstock reformed and the reforming process used. Processes disclosed herein may be used to reduce the benzene in the feed to less than 1 weight percent in some embodiments; less than 0.5 weight percent in other embodiments; less than 0.25 weight percent in other embodiments; less than 0.1 weight percent in other embodiments; less than 500 ppm by weight in other embodiments; less than 250 ppm by weight in other embodiments; less than 100 ppm by weight in other embodiments; less than 50 ppm by weight in other embodiments; less than 10 ppm by weight in other embodiments; and less than detectable limits in yet other embodiments. Additionally, processes disclosed herein may result in minimal or no loss of existing monoalkylate (toluene, ethylbenzene, cumene, etc.) present in the reformate feed.

Reformate streams may also include, for example, up to about 10 weight percent or more $C_{10+}$ polyalkyl aromatics, such as dialkyl benzenes, trialkyl benzenes, and tetraalkyl benzenes, depending upon the feedstock reformed and the reforming process used. In some embodiments, reformate streams containing about 2 to 5 weight percent tri- and tetraalkyl benzenes may be used.

Transalkylation reactions may be used to form a monoalkylate product by reacting benzene with polyalkylate. The transalkylating agent may be a polyalkylate aromatic hydrocarbon comprising two or more alkyl groups that each include from 2 to about 4 carbon atoms. For example, suitable polyalkylate aromatic hydrocarbons include di-, tri- and tetraalkyl aromatic hydrocarbons, such as diethylbenzene, triethylbenzene, diethylmethylbenzene (diethyltoluene), diisopropylbenzene, triisopropylbenzene, diisopropyltoluene, dibutylbenzene, and the like.

Reaction products which may be obtained from the transalkylation process of benzene may include, but are not limited to, ethylbenzene from the reaction of benzene with polyethylbenzenes; cumene from the reaction of benzene with polyisopropylbenzenes; sec-butylbenzene from the reaction of benzene and polybutylbenzenes, and similar monoalkyl aromatics from polyalkyl aromatics having one or more $C_2$ to $C_4$ alkyl group.

Reduction of benzene and polyalkyl aromatics content in reformate streams according to embodiments disclosed herein may be performed by fractionating a full range reformate into a light reformate, including the benzene, a medium reformats, including toluene and other $C_7$ to $C_9$ hydrocarbons, and a heavy reformate, including polyalkyl aromatic products in the reformate stream. The light reformate and heavy reformate may then be combined and contacted with a transalkylation catalyst to convert at least a portion of the benzene to a monoalkylate product, and to convert at least a portion of the polyalkyl aromatics to a monoalkyl aromatic or other lesser alkylated aromatic compounds (e.g., tetra-→tri-, di-, or mono-, tri-→di- or mono-, etc.). Additionally, as a side reaction, polyalkyl aromatics may react with monoalkyl aromatics and other polyalkyl aromatics, producing benzene, monoalkyl aromatics, and other polyalkyl aromatics. The amount of undesired side reactions, which may increase benzene content in a feed stream, may be limited based on feed quality and the reactor conditions selected. As toluene and other valuable $C_7$ to $C_9$ aromatics are removed from the transalkylation reactor feed, no loss of these valuable components due to the undesirable side reactions occurs.

The alkylation catalyst used may be such that the size of the catalyst particles is small enough to be suspended in the reformate, either prior to or within the transalkylation reaction zone. The catalyst particles may also be large enough to facilitate catalyst separation from the transalkylation reactor effluent using conventional separation techniques, such as settling, cyclone separations, and filtration. For example, the catalyst particle size may be in the range from about 5 microns to about 500 microns. In some embodiments, the catalyst particle size may be within the range from about 20 microns to about 200 microns.

As disclosed in, for example, U.S. Pat. Nos. 5,446,223, 5,118,872, 5,273,644, 4,849,569, 5,055,627, and 5,476,978, among others, solid acid catalyst, including, but not limited to, zeolitic catalysts and solid inorganic acid catalysts, such as sulfated zirconia and tungstated zirconia, may be used for the transalkylation of aromatic hydrocarbons, in particular for transalkylation of benzene, for their superior activity and selectivity. The catalyst particles may be suspended directly in the liquid reformate feed stream to the alkylation reactor or may be carried into the reactor as a separate phase. The concentration of catalyst in the slurry may vary over a wide range, depending on such process variables as the catalyst particle size, particle density, surface area, ratio of benzene to polyalkyl aromatic, temperature, and catalyst activity. The competing considerations of reactivity and physical dynamics of the reactants in a particular system may necessitate adjustment of several variables to approach a desired result.

Zeolites useful in embodiments disclosed herein may include natural and synthetic zeolites. Acidic crystalline zeolitic structures useful in embodiments disclosed herein may be obtained by the building of a three dimensional network of $AlO_4$ and $SiO_4$ tetrahedra linked by the sharing of oxygen atoms. The framework thus obtained contains pores, channels and cages or interconnected voids. As trivalent aluminum ions replace tetravalent silicon ions at lattice positions, the network bears a net negative charge, which must be compensated for by counterions (cations). These cations are mobile and may occupy various exchange sites depending on their radius, charge or degree of hydration, for example. They can also be replaced, to various degrees, by exchange with other cations. Because of the need to maintain electrical neutrality, there is a direct 1:1 relationship between the aluminum content of the framework and the number of positive charges provided by the exchange cations. When the exchange cations are protons, the zeolite is acidic. The acidity of the zeolite is therefore determined by the amount of proton exchanged for other cations with respect to the amount of aluminum.

Alkylation catalysts that may be used in some embodiments disclosed herein may include zeolites having a structure type selected from the group consisting of BEA, MOR, MTW, and NES. Such zeolites include mordenite, ZSM4, ZSM-12, ZSM-20, offretite, gmelinite, beta, NU-87, and gottardite. Clay or amorphous catalysts including silica-alumina and fluorided silica-alumina may also be used. Further discussion of alkylation catalysts may be found in U.S. Pat. Nos. 5,196,574; 6,315,964 and 6,617,481. Various types of zeolitic catalysts may be used for alkylation as well as other types of catalytic refinery processes. FCC processes may utilize at least one of a type Y, Beta, and ZSM-5, for example. The FCC zeolitic catalyst typically contains three parts: the zeolite, typically about 30 to 50 wt. % of the catalyst particle, an active matrix, and a binder. In one embodiment, the particle size of the FCC catalyst may be between 50 and 60 microns. In another embodiment, the zeolitic catalyst may initially come in ammonium form, which may be converted to the $H^+$ form by heating at over 300° C. before being used as an alkylation catalyst. One must take care not to overheat the catalyst prior to alkylation, because excessive temperature may dealuminate the zeolite and shrink the ring structures, which may reduce the activity for alkylation. In addition to zeolitic catalyst, inorganic catalyst, such as sulfated zirconia or tungstated zirconia, may be used for alkylation as well.

In some embodiments, suitable catalysts for alkylation and transalkylation may include metal stabilized catalysts. For example, such catalysts may include a zeolite component, a metal component, and an inorganic oxide component. The zeolite may be a pentasil zeolite, which include the structures of MFI, MEL, MTW, MTT and FER (IUPAC Commission on Zeolite Nomenclature), MWW, a beta zeolite, or a mordenite. The metal component typically is a noble metal or base metal, and the balance of the catalyst may be composed of an inorganic oxide binder, such as alumina. Other catalysts having a zeolitic structure that may be used in embodiments disclosed herein are described in U.S. Pat. No. 7,253,331, for example.

Certain zeolitic catalyst that may be used in an FCC reactor may also be used in an alkylation reactor according to embodiments disclosed herein. In one embodiment, a fresh MWW type zeolitic catalyst may be used to facilitate aromatics alkylation, and when spent, it may be further fed to an FCC unit as an equilibrium catalyst. In another embodiment, an FCC catalyst may be fed to an alkylation reactor as make-up catalyst.

One advantage of using FCC catalyst for benzene transalkylation is that the catalyst can be used without any added catalyst cost to the refinery. For example, using the FCC catalyst regeneration facilities instead of providing new regeneration facilities for the transalkylation unit may provide significant capital cost savings, especially for a small refiner.

Referring now to FIG. 1, a simplified process flow diagram for reformate benzene reduction according to embodiments disclosed herein is illustrated. A full range reformate, including benzene, toluene and other $C_7$ to $C_9$ monoalkyl aromatics, and $C_{10+}$ polyalkylate, may be fed via flow line 102 to a reformate splitter 10, where the full range reformate may be fractionated into a light reformate fraction, including benzene, and a medium reformate fraction, including toluene and other $C_7$ to $C_9$ monoalkyl aromatics, and a heavy reformate, including the $C_{10+}$ polyalkylate existing in the reformatted feed. The light reformate may be recovered as an overheads fraction from the reformate splitter 10 via flow line 104; the medium reformate fraction may be recovered from splitter 10 as a side draw via flow line 106; and, the heavy reformate may be recovered as a bottoms fraction from the reformate splitter 10 via flow line 108.

Transalkylation catalyst fed via flow line 110 may be slurried with the overheads fraction and the bottoms fraction, and the resulting slurry may be fed to flow reactor 20. Alternatively, the catalyst and reformate fractions may be fed to flow reactor 20 separately. If desired, additional heavy aromatics, such as other polyalkyl aromatic-containing hydrocarbon streams may be co-fed to reactor 20 via flow line 109. As illustrated in FIG. 1, flow reactor 20 may include a tubular reactor, a continuous stirred tank reactor (CSTR) or other types of flow reactors known to those skilled in the art. Conditions in flow reactor 20 are suitable for converting at least a portion of the benzene and polyalkyl aromatics to monoalkyl aromatics. Effluent from the flow reactor may be recovered via flow line 112, where the effluent may include monoalkylate, polyalkylate, catalyst, and unreacted benzene, if any.

The reactor effluent may be fed via flow line 112 to a separator 30 for separating the catalyst from the reformate having a reduced benzene and polyalkylate content. A liquid fraction, comprising the monoalkylate product, unreacted benzene, and polyalkylate may be separated from the catalyst in separator 30 and recovered via flow line 114. A catalyst fraction, which may include some liquid to facilitate transport, may be recovered via line 116.

At least a portion of the catalyst fraction recovered from separator 30 in flow line 116 may be recycled to the alkylation reactor 20 via flow line 110. Likewise, at least a portion of the catalyst fraction in flow line 116 may be purged via flow line 118, such as for regeneration or disposal. In some embodiments, the catalyst purged via flow line 118 may be fed to an FCC unit for catalyst use and/or regeneration. Make-up catalyst may be added to flow line 110 via flow line 119, or may be directly added to alkylation reactor 20.

Conventional methods for separating the catalyst fraction from the liquid fraction in the transalkylation reactor effluent may include at least one of filtration, settlement, and centrifugation or cycloning. The catalyst fraction may subsequently undergo at least one of recycling, regeneration, and disposal, where recycling and/or regeneration may be performed in a stand alone unit or may be integrated with an FCC unit.

In one embodiment, the transalkylation reactor effluent may be fed to a hydrocyclone separator, similar to the ones typically used in an FCC unit. Liquid and catalyst fractions including the transalkylation reactor effluent enter the hydrocycle and a vortex flow may be established, wherein a liquid fraction may be separated from a catalyst fraction, which can be separately removed. The catalyst fraction may comprise mostly the spent catalyst and at least some residual liquid from the effluent, while the liquid fraction may contain very little or no residual catalyst.

One benefit of using a heterogeneous catalyst slurry reactor over a fixed catalyst bed reactor is reduction in catalyst fouling rate due to poisoning and coking, which leads to rapid catalyst deactivation. Retardation of the catalyst deactivation rate may be achieved by maintaining at least a partial liquid level over the catalyst, for example, in a liquid slurry.

As previously stated, another benefit of a heterogeneous catalyst slurry system is that the spent or deactivated catalyst may be removed and make-up catalyst may be added without causing additional process interruptions. The ability to remove deactivated catalyst on-line eliminates the need to remove catalyst poisons from the feeds or regenerate the catalyst in a fixed bed reactor, thus reducing the cost of the benzene removal unit.

A further benefit of using a heterogeneous catalyst slurry is that an on-line regeneration system may be used to regenerate the spent catalyst from the transalkylation reactor and return it back into the system, all without causing additional process interruptions. For example, a small refiner may find it economically feasible to combine the existing FCC catalyst system with a new transalkylation reactor for removal of benzene from reformate, comprising using the existing FCC catalyst regeneration unit for regenerating the spent catalyst from the transalkylation reactor.

Typically, the amount of spent catalyst generated by the transalkylation reactor is less than the make-up requirements for the FCC unit. For example, the spent catalyst rate from the transalkylation benzene removal unit may be in the range of 4 to 400 kg/hr. A typical FCC unit may add 100 kg/hr to 400 kg/hr or more of fresh catalyst, as based on a catalyst consumption rate from about 1 to about 5 metric tons per day.

In one embodiment, the catalyst is fed to the transalkylation reactor in a single pass, whereas all the spent catalyst removed from the transalkylation reactor effluent is fed to the FCC, and whereas no regenerated catalyst from the FCC is returned to the transalkylation reactor. As a variation, regenerated FCC catalyst may comprise at least a portion of the make-up catalyst for the transalkylation reactor.

The transalkylation reaction conditions may be selected to yield the desired monoalkylate products without undue detrimental effects upon the catalyst or transalkylation reactants, such as catalyst deactivation, cracking, or carbon formation. Generally, the reaction temperature may range from 100° F. to 600° F. In some embodiments, suitable operating temperature may be in the range from about 100° F. to 400° F.; from about 150° F. to about 300° F. in other embodiments. The temperature may vary depending on the reactants and product. The reaction pressure should be sufficient to maintain at least a partial liquid phase in order to retard catalyst fouling. This is typically 50 to 1000 psig, depending on the feedstock and reaction temperature. In some embodiments, operating pressures may range from about 200 to 400 psig. In a catalyst slurry flow reactor, the pressure may generally be maintained high enough to ensure minimal evaporation losses at the desired reactor operating temperature.

In moving bed reactors, where the catalyst is mixed with the liquid feed stream to produce a slurry, the reactor pressure is generally maintained high enough to ensure minimal evaporation losses at the desired reactor operating temperature. In such systems, it is imperative that the catalyst stays wetted at all times to prevent rapid catalyst fouling and premature deactivation. Premature catalyst deactivation may significantly increase unit operating costs by one or more of: requiring more frequent replacement of spent catalyst with either fresh or regenerated catalyst; increase unit downtime in case of reactors using fixed catalyst beds, which cannot be replaced on-line; and cause production of undesirable impurities and other contaminants that may decrease the value of the reaction product stream. In case of catalyst regeneration, significant capital cost may be required to increase the catalyst regeneration unit capacity in order to handle the additional catalyst regeneration load due to rapid catalyst deactivation in the transalkylation reactor.

Advantageously, embodiments disclosed herein may provide for reduction of undesirable benzene content in the full range reformate. Additionally, embodiments disclosed herein provide a method for concurrent reduction of undesirable polyalkylate in at least one of full range reformate and FCC heavy cycle oil. The resulting liquid hydrocarbon product, having a reduced benzene and polyalkylate content, may be readily blended, along with the medium reformate fraction, into motor gasoline, while also meeting the stringent environmental and safety government regulations.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A process for reducing benzene content in a reformate stream, comprising:

fractionating a full range reformate comprising benzene, $C_7$ to $C_9$ monoalkyl aromatics, and $C_{10+}$ polyalkyl aromatics into at least three fractions including a light reformate fraction comprising the benzene; a medium reformate fraction comprising the $C_7$ to $C_9$ monoalkyl aromatics; and a heavy reformate fraction comprising the $C_{10+}$ polyalkyl aromatics;

feeding the light reformate fraction, the heavy reformate fraction and a transalkylation catalyst to a transalkylation reaction zone;

contacting the light fraction and the heavy fraction in presence of the transalkylation catalyst in the transalkylation reaction zone to react at least a portion of the benzene with $C_{10+}$ polyalkyl aromatics to form monoalkyl aromatics;

separating an effluent from the transalkylation reaction zone to form a catalyst fraction and a liquid fraction comprising the monoalkyl aromatics, wherein the liquid fraction has a benzene concentration of less than 1 weight percent.

2. The method according to claim 1, further comprising recycling at least a portion of the catalyst fraction to the transalkylation reaction zone.

3. The method according to claim 1, further comprising feeding at least a portion of the catalyst fraction to an FCC unit.

4. The method according to claim 3, further comprising feeding catalyst from the FCC unit as the transalkylation catalyst.

5. The method according to claim 1, wherein the catalyst comprises at least one of a zeolite catalyst and a solid inorganic acid catalyst.

6. The method according to claim 1, wherein the catalyst has a particle size between 5 and 500 microns.

7. The method according to claim 1, wherein the transalkylation reaction zone operates at a temperature in the range from about 100° F. to about 400° F.

8. The method of claim 1, further comprising blending the medium fraction with the liquid fraction.

9. The method of claim 1, further comprising blending at least one of the medium fraction and the liquid fraction to form a gasoline fuel.

10. The method of claim 1, wherein the liquid fraction has a benzene concentration of less than 100 ppm by weight.

11. The method of claim 1, wherein the liquid fraction has a benzene concentration of less than 10 ppm by weight.

12. The method of claim 1, wherein the liquid fraction has a benzene concentration below detectable limits.

* * * * *